US005775249A

United States Patent [19]

Samuel

[11] Patent Number: 5,775,249

[45] Date of Patent: Jul. 7, 1998

[54] ADJUSTABLE CAMBER INFLATABLE SAIL

[76] Inventor: David B. Samuel, 27241 Pasco Peregrino, San Juan Capistrano, Calif. 92675

[21] Appl. No.: 629,321

[22] Filed: Apr. 8, 1996

[51] Int. Cl.[6] ..... B63H 9/06

[52] U.S. Cl. ..... 114/103

[58] Field of Search ..... 114/102, 103

[56] References Cited

U.S. PATENT DOCUMENTS

| | | | |
|---|---|---|---|
| 4,064,821 | 12/1977 | Roberts, Jr. | 114/103 |
| 4,186,680 | 2/1980 | Harpole | 114/103 |
| 4,341,176 | 7/1982 | Orrison | 114/102 |
| 4,369,724 | 1/1983 | Weiss | 114/39 |
| 4,388,888 | 6/1983 | Gushurst, Jr. | 114/90 |
| 4,402,277 | 9/1983 | Wainwright | 114/103 |
| 4,437,426 | 3/1984 | Latham | 114/103 |
| 4,530,301 | 7/1985 | Latham | 114/102 |
| 4,537,146 | 8/1985 | Wainwright | 114/103 |
| 4,625,671 | 12/1986 | Nishimura | 114/103 |
| 4,637,331 | 1/1987 | Jackson | 114/39 |
| 4,646,671 | 3/1987 | Innes et al. | 114/103 |
| 4,649,848 | 3/1987 | Belvedere | 114/103 |
| 4,685,410 | 8/1987 | Fuller | 114/102 |
| 4,702,191 | 10/1987 | Minami et al. | 114/106 |
| 4,703,707 | 11/1987 | Anderson | 114/102 |
| 4,704,979 | 11/1987 | Ammen et al. | 114/98 |
| 4,708,078 | 11/1987 | Legaignaux et al. | 114/102 |
| 4,708,079 | 11/1987 | Magnan | 114/103 |
| 4,733,624 | 3/1988 | Belvedere | 114/103 |
| 4,741,282 | 5/1988 | Duke | 114/103 |
| 4,753,186 | 6/1988 | Parai | 114/103 |
| 4,770,113 | 9/1988 | Walker | 114/102 |
| 4,848,258 | 7/1989 | Priebe | 114/103 |
| 4,852,507 | 8/1989 | Ryon et al. | 114/39.1 |
| 4,864,949 | 9/1989 | Olsen | 114/39.1 |
| 4,879,961 | 11/1989 | Aguilera | 114/102 |
| 5,119,748 | 6/1992 | Nishimura | 114/39.2 |
| 5,263,429 | 11/1993 | Brinkmann | 114/105 |
| 5,271,349 | 12/1993 | Magrini | 114/39.1 |
| 5,279,241 | 1/1994 | Aguilera | 114/103 |
| 5,423,276 | 6/1995 | Nishimura | 114/39.2 |

*Primary Examiner*—Sherman Basinger

[57] ABSTRACT

The invention includes a two-piece adjustable camber wing-shaped inflatable sail for use as a main and or misin sail and a two-piece adjustable camber wing-shaped inflatable sail for use as a head sail, by contemporary sailing vessels with conventional sail rigs having a mast, boom, headstay, backstay, and sidestays. The main sail features a leading edge and physically separate main body, each having two inflatable cells; one port and starboard, enclosed in an outer cover. The main body will attach to the mast in a conventional manner. The leading edge of the main sail will attach to the front and side portions of the mast and feature two inflatable cell pockets; port and starboard, which to insert independent port and starboard semi-wedge shaped inflatable cells. The leading edge of the main sail will extend from just above the deck to the masthead. The leading edge of the head sail will attach to the headstay and feature two inflatable cell pockets; port and starboard, which to insert independent port and starboard semi-wedge shaped inflatable cells or a solid non-inflatable lightweight core. It will extend from just above the foredeck to the masthead. The main body portions of the main sail and headsail will each feature a center panel, two forward panels, two outer panels, bottom panel, and a plurality of horizontally positioned shaping panels that together form a two-chamber inflatable cell. The inflatable cells can be inflated or deflated independently to adjust the shape of the adjustable camber wing-shaped inflatable sails.

33 Claims, 10 Drawing Sheets

Fig.3
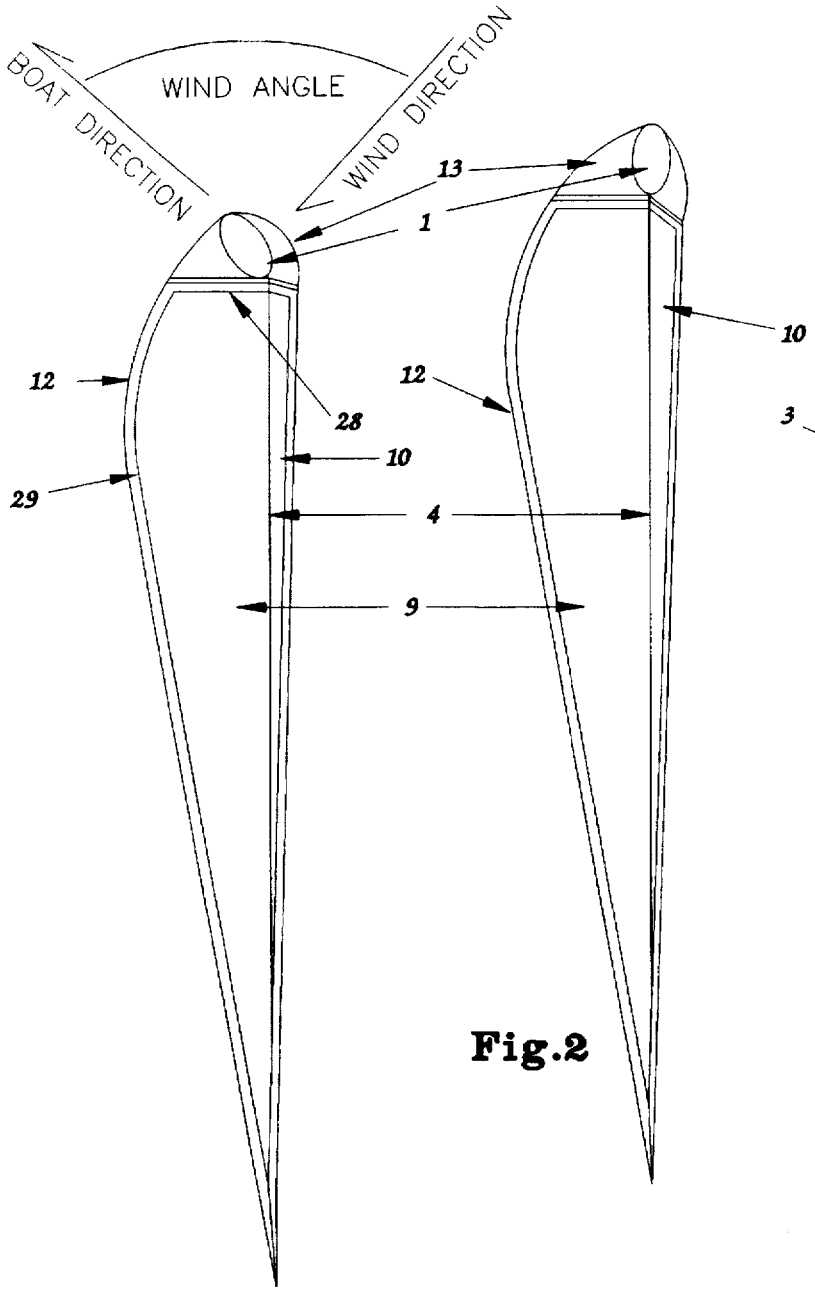
Fig.4
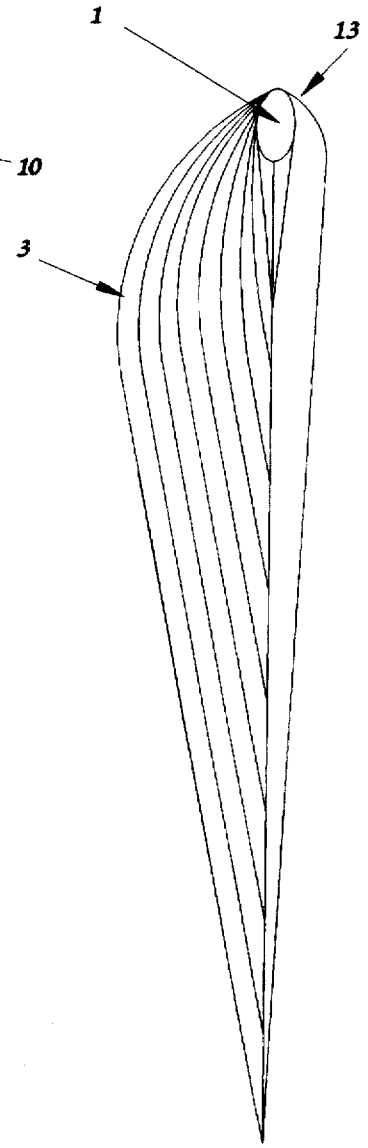
Fig.2

Fig. 11
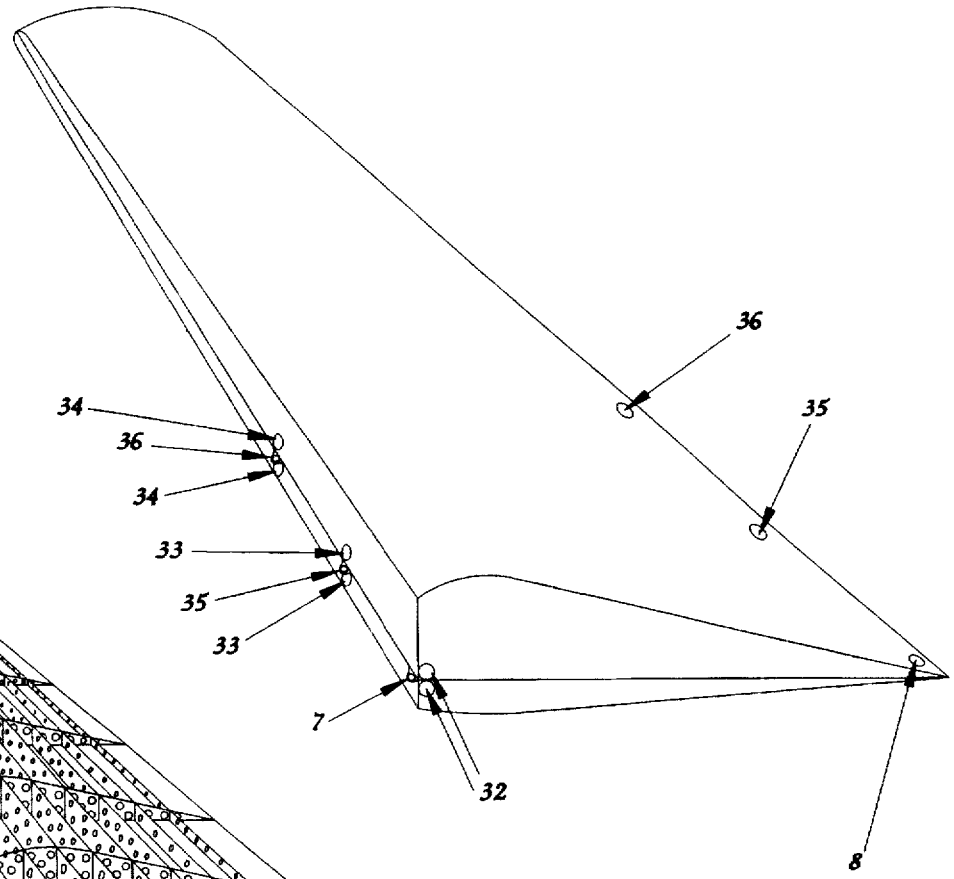
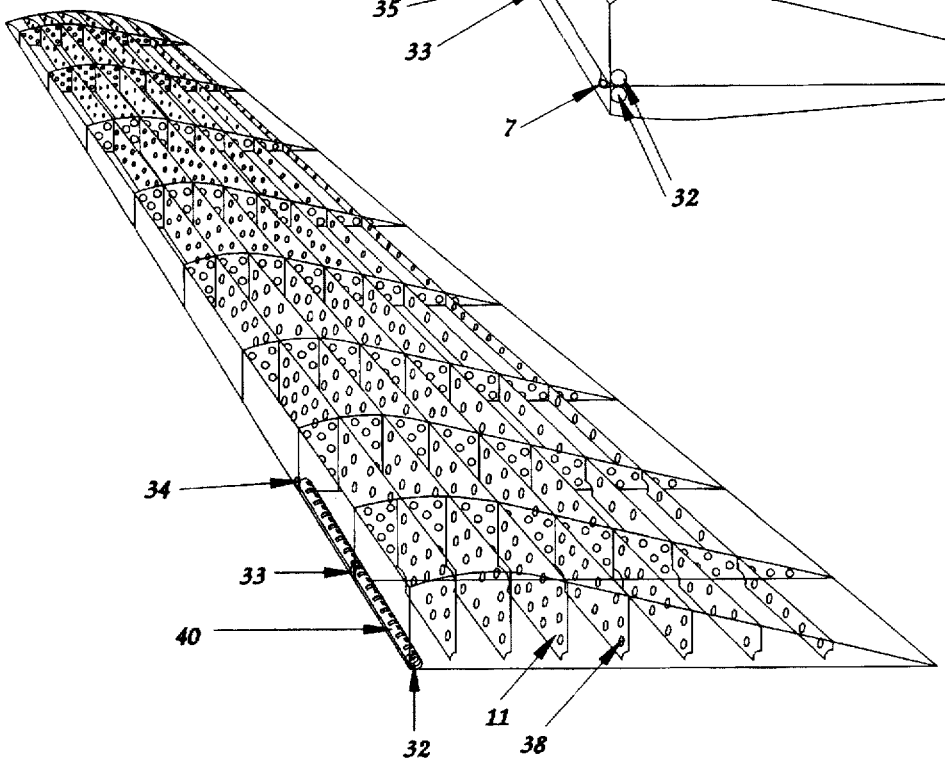
Fig. 12

Fig.18
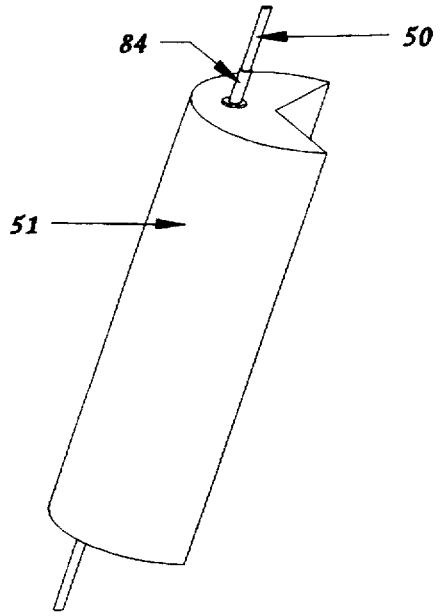
Fig.19
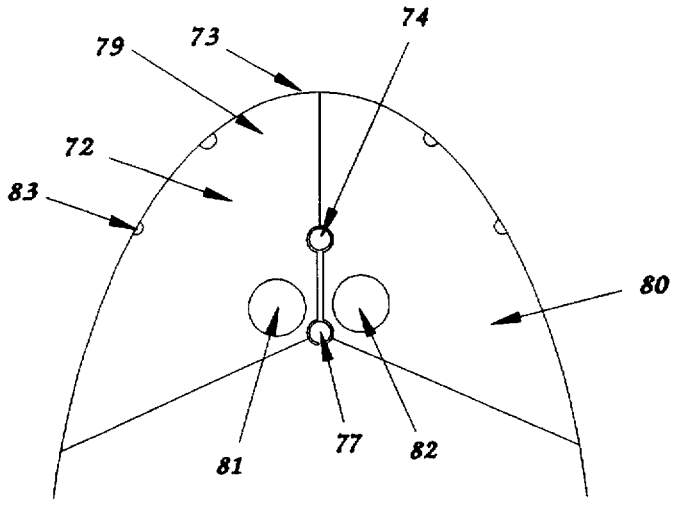
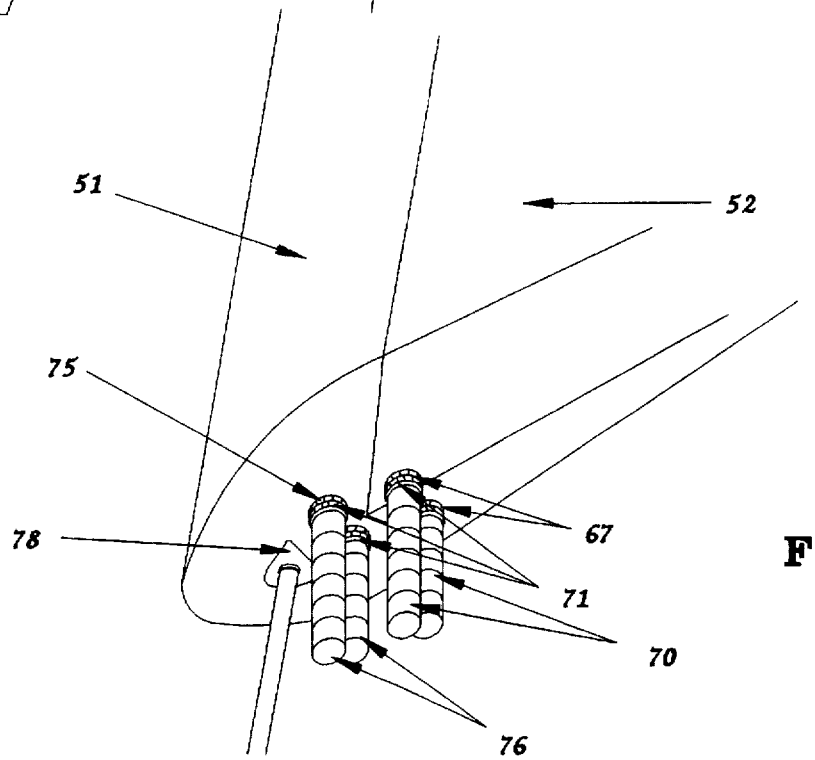
Fig.20

ADJUSTABLE CAMBER INFLATABLE SAIL

BACKGROUND OF THE INVENTION—PRIOR ART

A majority of the design changes used to improve the performance of sailing vessels has been below the water line particularly in the design of the hull and keel, or the use of lighter weight materials. However little, if any improvements have been made to the sails that is used to power sailing vessels. The design of the sails used to power ancient sail vessels are very similar to the sails used to power contemporary sailing vessels. The principles that define the performance characteristics of a sail used to power a sailing vessel are similar as the principles that define the performance characteristics of a wing used to power an aircraft. Therefore, the principles and experimentation used to design a wing used to power an aircraft can also be used to design a sail that can be used to power a sailing vessel. This invention allows the sailing vessel to benefit from the airfoil design technology used in aircraft wing design. The principles used to design the most efficient wing for use by an aircraft is used to design the most efficient wing shaped sail for use by a sailing vessel. The design of the invention (adjustable camber wing shaped sail) is based on the theories, principles, and experimentation used by the (NACA) National Advisory Committee for Aeronautics, United States to design and test airfoils, which are public domain.

The performance characteristics of a flat wing used to power an aircraft is substantially less efficient than the performance characteristics of a thicker asymmetrical wing in low-speed flight conditions. Therefore, it is logical to conclude that a thicker sail would be more efficient than a flat sail. The primary problem of past wing shaped sail designs have been that the benefits gained by the superior design (more efficient airfoil shape) was outweighed by the increased weight of a fixed wing structure using rigid materials can withstand the loads. In order for a wing-shaped sail to provide superior performance characteristics compared to that of conventional flat sail, the weight of the wing-shaped sail must be reduced. Several improved sail designs have been proposed including rigid, ribbed and inflatable sails. To date, none of these sail designs have been proven to provided sailing characteristics considered sufficiently superior to that of a conventional flat sail to be marketed and used on contemporary sailing vessels. This invention (adjustable camber wing-shaped sail) will prove to provide superior sailing performance including greater lift and ability to point higher than sailing vessels using conventional sails.

This invention (adjustable camber wing-shaped sail) has the lift characteristics similar to the lift characteristics of a fixed wing sail, but is substantially lighter than current fixed, ribbed, or inflatable designs. Unlike fixed wing designs, the shape of the invention (adjustable camber wing-shaped sail) sail is defined by inflatable cells that are substantially lighter than the aforementioned fixed wing sails that use ridged (metal, wood, or other similar material) to define the shape of the sail. The invention (adjustable camber wing-shaped sail) has been designed to allow it to be used on conventional sailing rigs without substantial modifications to the contemporary sailing vessel.

Unlike symmetrical ribbed or inflatable sail designs, the multi-cell design of this invention allows the shape of the sails to be adjusted to increase the lift characteristics of the sails on various points of sail. The superior sailing characteristics of the invention (adjustable camber wing-shaped sail) include greater lift, ability to sail (point) at a closer angle to the wind than vessels using conventional flat sails and ability for use by sailing vessels with conventional mast-boom sailing rig. These characteristics outweigh the increased weight compared to a conventional flat sail. The purpose of this invention is to provide a sail that has superior performance characteristics compared to contemporary flat sails, fixed airfoils, and symmetrical inflatable sail designs that can be used by conventional sailing vessel.

BRIEF DESCRIPTION OF THE DRAWINGS

FIG. 2 is a cross section view of the main sail portion of the invention in a fully inflated state as if the boat was on a starboard tach with a wind angle of 0 degrees, attached to a mast.

FIG. 3 is a cross section view of the main sail portion of the invention in a fully inflated state as if the boat was on a starboard tach on a beam reach point of sail, attached to a mast.

FIG. 4 is an aerial view (viewing down from the masthead to the deck of the boat) of the main sail portion of the invention in a fully inflated state as if the boat was on a starboard tach, attached to a mast.

FIG. 11 is an isometric view of the main body portion of the main sail in a fully inflated state.

FIG. 12 is an isometric view of the port side inflatable cell used in the main body portion of the main sail (starboard inflatable cell will be a mirror image).

FIG. 18 is an isometric view of the leading edge cone portion of the headsail.

FIG. 19 is a cross section view of the leading edge cone portion of the headsail.

FIG. 20 is an isometric view of the bottom wall of the headsail (leading edge cone and main body). The figure shows the inflation hoses attached to the main connecting valves.

REFERENCE NUMERALS IN DRAWINGS

1 Mast
2 Boom
3 Main Body Sail
4 Center Panel
5 Main Halyard
6 Head Grommet
7 Tack Grommet
8 Clew Grommet
9 Port side Inflatable Cell—Main Sail
10 Starboard side Inflatable Cell-Main Sail
11 Shaping Panels
12 Outer Cover
13 Leading Edge Portion
14 Inner Wall
15 Port Inflatable Cell-Leading Edge
16 Starboard Inflatable Cell-Leading Edge
17 Leading Edge Outer Cover
18 Leading Edge Rear Wall
19 Leading Edge Cell Shaping Panels
20 Leading Edge Cell Pass-through Holes
21 Leading Edge-Inflating/deflating Tubes
22 Leading Edge Main Connecting Valves
23 Leading Edge Inflation Hose
24 Leading Edge Male/Female Couplings
25 Inflation/deflation Tube Opening Ports
26 Inflation/deflation Tube Rigid Shaping Rings
27 Inflation/deflation Tube Flexible Cover
28 Main Sail Inflatable Cell Forward Wall
29 Main Sail Inflatable Cell Outer Wall
30 Main Sail Attachment Points
31 Main Sail Inflatable Cell Bottom Wall
32 Main Sail Bottom Connecting Valves
33 Main Sail First Reef Point Connecting Valves
34 Main Sail Second Reef Point Connecting Valves
35 Main Sail First Reef Point Grommets
36 Main Sail Second Reef Point Grommets
37 Main Sail Inflation Hoses
38 Inflatable Cell Pass-through Holes
39 Main Sail Shifting Slots
40 Main Body Sail-Inflating/deflating Tubes
50 Headstay
51 Leading Edge Cone portion of the Head Sail
52 Main Body portion of the Head Sail
53 Main Body Inflatable Cell Center Panel
54 Head Sail Halyard
55 Head Sail Head Grommet
56 Head Sail Tack Grommet
57 Head Sail Clew Grommet
58 Head Sail Outer Panel
59 Head Sail Forward Panel
60 Inflatable Cell Pass-through Holes
61 Head Sail Headstay Attachments
62 Head Sail Port side Inflation/deflation Tubes
63 Head Sail Starboard side Inflation/deflation Tubes
64 Head Sail Port side Inflatable Cell
65 Head Sail Starboard side Inflatable Cell
66 Head Sail Outer Cover
67 Head Sail Main Connecting Valves
68 Head Sail Inflatable Cell Shaping Panels
69 Head Sail Shifting Slots
70 Head Sail Main Body Inflation Hoses
71 Male/Female Locking Couplings
72 Head Sail Leading Edge Core
73 Head Sail Leading Edge Outer Cover
74 Head Sail Leading Edge Headstay tube
75 Head Sail Leading Edge Connecting Valves
76 Head Sail Leading Edge Inflation Hoses
77 "C" Shaped Headstay Attachment Channel
78 Lower Swivel Plate
79 Head Sail Leading Edge Port Side Inflating Cell
80 Head Sail Leading Edge Starboard Side Inflating Cell
81 Head Sail Leading Edge Port Inflating/deflating Tube
82 Head Sail Leading Edge Starboard Inflating/deflating Tube
83 Head Sail Leading Edge Hinge Points
84 Upper Swivel Plate
85 Two-piece Velcro® System
86 Head Sail Leading Edge Bottom Walls
87 Head Sail Leading Edge Zipper

DETAILED DESCRIPTION OF THE INVENTION

Figure 1:
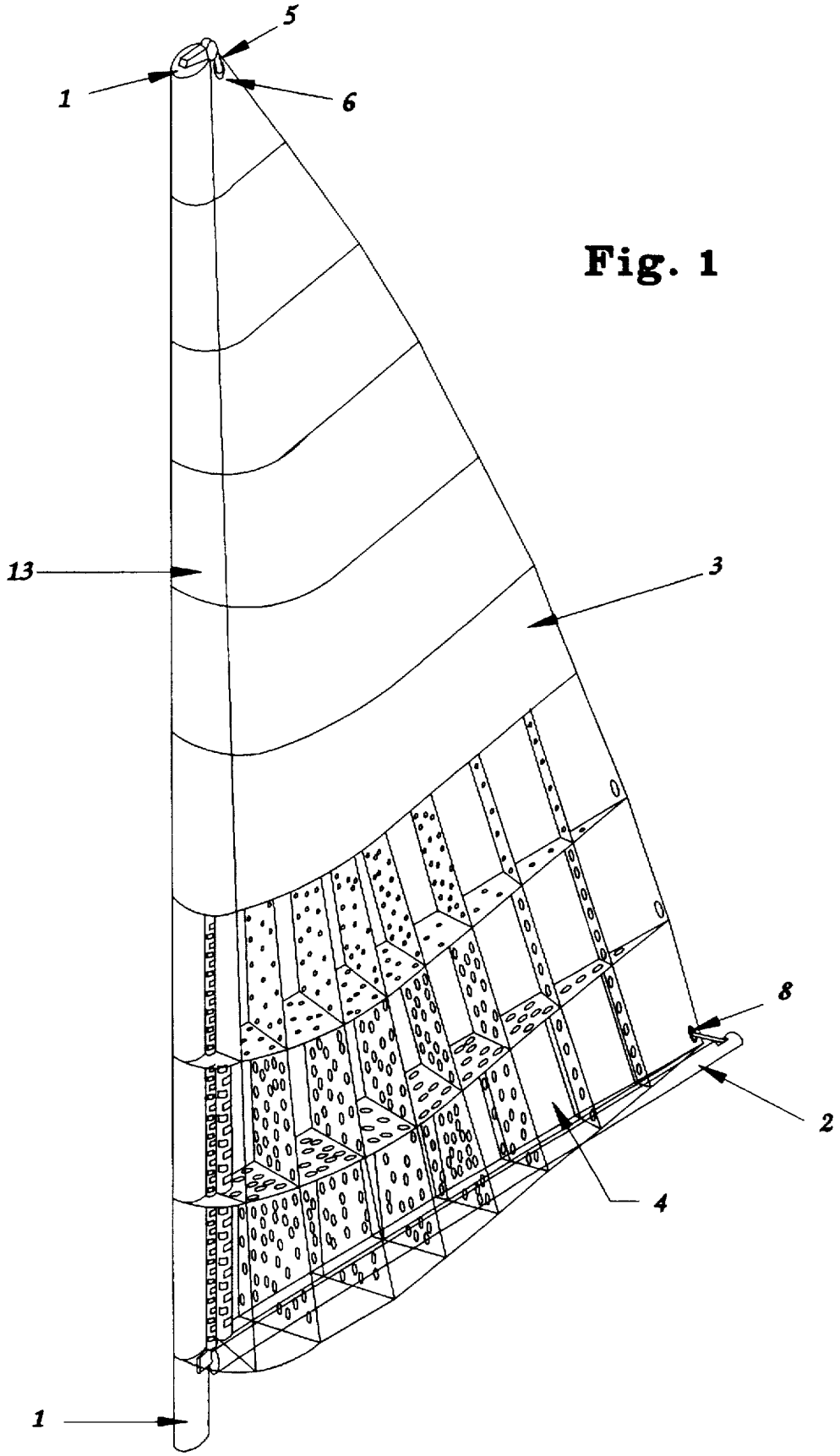
FIG. 1 is a cut away isometric view of the main sail portion of the invention in a fully inflated state, attached to a mast.

FIG. 1 is a cut away isometric view of the main sail portion of the invention, the adjustable camber wing-shaped sail in a fully inflated state. This view shows the main body portion 3 and leading edge portion 13 attached to a conventional sailing rig of a typical sail boat that includes a fixed mast 1 and a boom 2. The main body portion 3 is attached to the mast 1 in a conventional manner that includes either: 1) a continuous cord incorporated into the luff portion of center panel 4 (refer to FIG. 2) of the main body portion 3 of the main sail that slides into a slot in the mast, or 2) several attachment points incorporated into the luff portion of the center panel 4 of the main body portion 3 of the main sail that attach to several cars (or slides) that move along the length of the mast 1.

Figure 5:
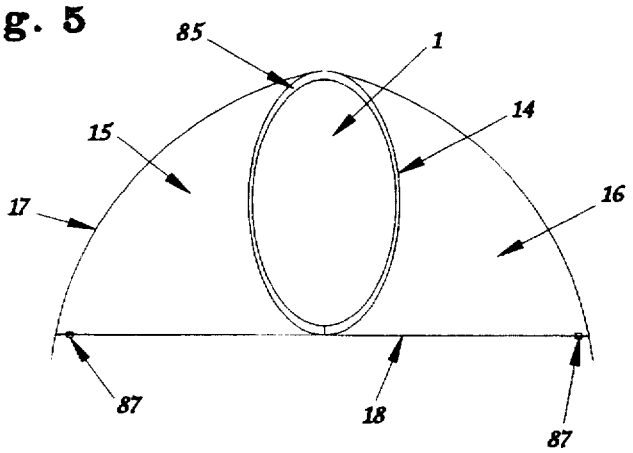
FIG. 5 is a cross section view of mast and leading edge portion of the main sail, attached to a mast.
Figure 6:
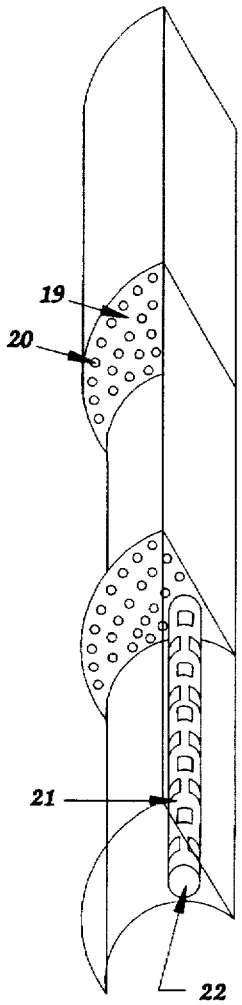
FIG. 6 is an isometric view of the inflatable cell used in the leading edge portion of the main sail.

The main body portion 3 of the main sail is raised and lowered in a conventional manner using a main halyard 5 that is attached to a grommet 6 incorporated into the head portion of the sail 3. The sail 3 also includes a grommet 8 incorporated into the clew portion of the sail 3 (as illustrated in FIG. 11) that is used to flatten the sail 3 using a conventional outhaul system. The sail 3 also includes a grommet 7 (as illustrated in FIG. 11) incorporated into the tack portion of the sail 3 that is used to attach the sail 3 to the forward portion of the boom 2. FIG. 1 also shows the structure of the inflatable cells of the main sail 3 portion of the sail (as illustrated in FIG. 11 and 12) and leading edge portion 13 (as illustrated in FIG. 5 and 6).

FIG. 2 is a cross section view of the adjustable camber inflatable wing-shaped sail in a fully inflated state (on starboard tach). This view shows the main sail attached to a conventional fixed mast 1. The main sail will feature a leading edge portion 13 and a main body portion 3.

The main body portion 3 of the main sail will feature two inflatable cells (port inflatable cell 9 and starboard inflatable cell 10) enclosed in an outer cover 12. The outer cover 12 can be manufactured using an elastic material that will stretch. The two inflatable cells of the main body portion 3 feature a common center panel 4, forward wall 28, outer wall 29, outer cover 12, and shifting slots 39. Refer to FIGS. 9, 10, 11 and 12 for a more detailed illustration of the main body portion 3.

FIG. 3 is a cross section view of the adjustable camber inflatable wing-shaped sail in a fully inflated state, as it would be used to power a boat at a broad reach point of sail. This view shows the main sail attached to a conventional fixed mast 1.

FIG. 4 is an isometric view of the main sail (main body portion 3 and leading edge portion 13) attached to a mast 1 viewing parallel with the mast (looking down from the top of the mast toward the boat deck).

FIG. 5 is a cross section of the leading edge portion 13 and mast 1. The leading edge portion 13 is attached to the mast 1 with a two-piece Velcro® system 85 (or attachment system or method that has similar attachment characteristics) extends from the lower portion of the mast, just above the boom to within a few inches from the masthead. One part of the Velcro® system is attached to the mast 1 with a glue or other semi-permanent attachment system and the other part is attached to the inner wall 14 of the leading edge portion 13. The leading edge portion will each feature two inflatable cells (port inflatable cell 15 and starboard inflatable cell 16) contained in two cell pockets, which are each formed by an inner wall 14, outer cover 17, and a rear wall 18. The rear walls 18 are attached to the outer cover with a zipper 87. The cell pockets will extend from the lower portion of the mast, just above the boom to within a few inches from the masthead.

The inner wall 14 and rear wall 18 of the cell pockets will be manufactured using a non-elastic or semi-non-elastic material such as conventional sail cloth (canvas, mylar, dacron, etc.) that will resist stretching when pressure is applied from the inflation of the inflatable cells (port inflatable cell 15 and starboard inflatable cell 16). The outer cover 17 will be manufactured using a non-elastic material such as plastic, fiberglass, or other material that has similar characteristics.

When fully inflated, the two inflatable cells (port inflatable cell 15 and starboard inflatable cell 16) will form a semi-wedge shape as seen in FIG. 6. The inflatable cells contained in the cell pockets will extend from the lower portion of the mast, just above the boom to within a few inches from the masthead. The inflatable cells (port inflatable cell 15 and starboard inflatable cell 16) will be manufactured using a non-porous or semi non-porous flexible material. The inflatable cells will feature a non-porous or semi non-porous outer cover 17 with shaping panels 19 (as illustrated in FIG. 6) attached to the interior opposed sides of the inflatable cells (port inflatable cell 15 and starboard inflatable cell 16).

Figure 7:
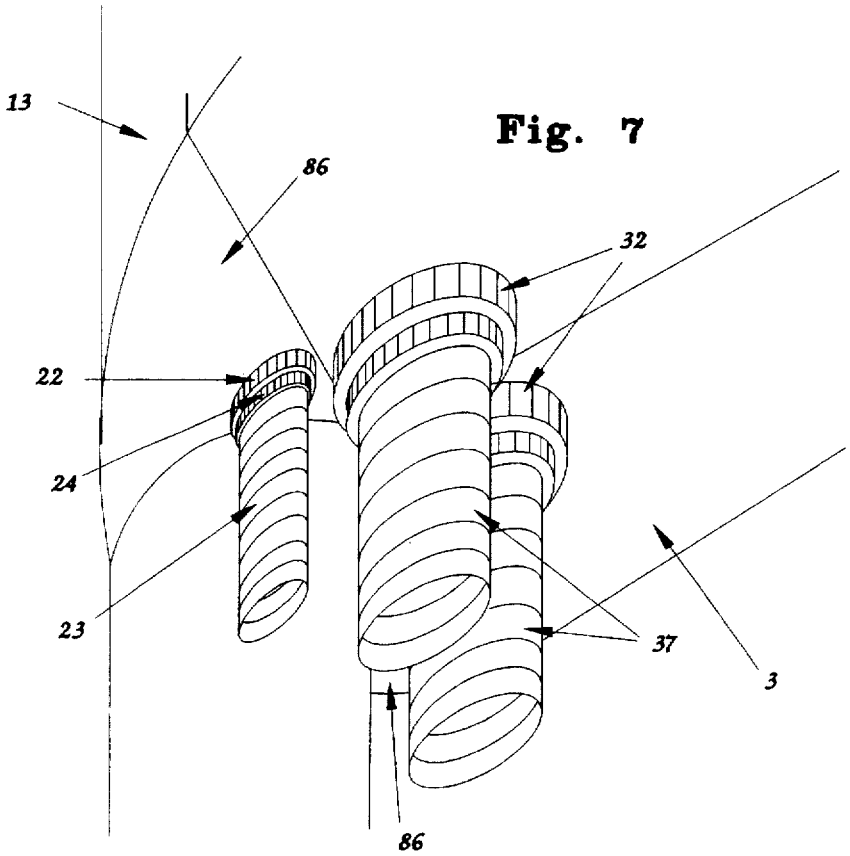
FIG. 7 is an isometric view of the bottom wall of the main sail (leading edge and main body). The figure shows the inflation hoses attached to the main connecting valves.

FIG. 6 is isometric view of a portion of the leading edge port side inflatable cell (starboard side inflatable cell 16 will be a mirror image). The inflatable cell is formed by an inner wall, outer wall, rear wall, and bottom wall. The inner wall, outer wall, rear wall, and bottom wall will be manufactured using a non-porous material. The inflatable cells will each feature shaping panels 19 attached to the interior opposed sides of the cell (inner wall, outer wall, rear wall, and bottom wall). These shaping panels 19 will be attached (using glue, heat, or other existing or future bonding method) to the inner walls of the cells. These shaping panels 19 will define the shape of the inflatable cell (port inflatable cell 15 and starboard inflatable cell 16) when inflated with an inflation medium. These shaping panels 19 will have pass-through holes 20 that will allow the inflation medium to pass from the various sections of the inflatable cell (port inflatable cell 15 and starboard inflatable cell 16). Each of the two inflatable cells (port inflatable cell 15 and starboard inflatable cell 16) will feature one inflating/ deflating tube 21. The inflating/deflating tubes 21 will extend the entire length of the inflatable cell. See FIG. 8 for a more detailed view of the inflating/deflating tubes. The inflating/deflating tube 21 (port and starboard) will connect to a main connecting valve 22 (one port and one starboard) located at the bottom of the leading edge portion of the sail 3. Refer to FIG. 7 for a detail.

The two inflatable cells (port inflatable cell 15 and starboard inflatable cell 16) can be inflated or deflated both in unison or independently to adjust the shape of the leading edge portion 13 of the main sail. The inflatable cells (port inflatable cell 15 and starboard inflatable cell 16) will be inflated with an inflation medium that will be transferred into the inflatable cell (port inflatable cell 15 and starboard inflatable cell 16) via a main inflatable/deflatable tube 21 incorporated into the inflatable cell (see FIG. 6). The inflation medium will be transferred into the inflating/deflating tubes 21 via the main connecting valves 22 that connects to an inflation hose 23 (refer to FIG. 7).

FIG. 7 is an isometric view of the bottom walls of the main sail (main body portion 3 and leading edge portion 13 of the main sail). The inflation medium will be transferred into the leading edge inflating/deflating tubes via connecting valves 22, which are connected to the inflation hoses 23. One of the two inflatable hoses connects to the port main connecting valve and the other to the starboard main connecting valve. The inflation hoses 23 will attach to connecting valves 22 using male/female locking couplings 24.

This figure also shows the main connecting valves 32 and inflation hoses 37 that are part of the main body portion 3 of the main sail. One of the two inflatable hoses connects to the port main connecting valve and the other to the starboard main connecting valve. The inflation hoses 37 will attach to the main connecting valves 32 using male/female locking couplings.

Figure 8:
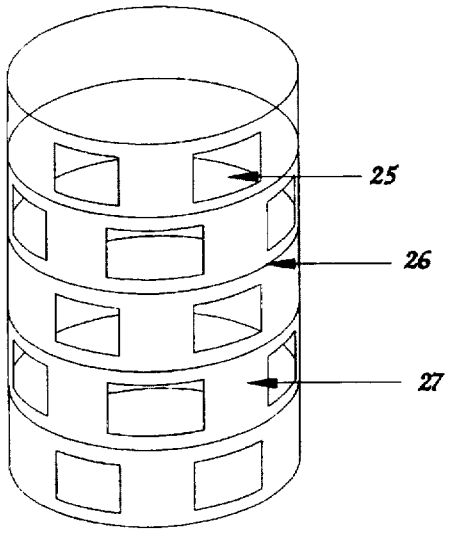
FIG. 8 is an isometric view of a small section of the inflating/deflating tube, which is contained in the inflatable cells.

FIG. 8 is an isometric view of a small section of the inflating/deflating tube that is part of the leading edge inflatable cells and main body inflatable cells. The inflating/deflating tubes will feature open ports 25, rigid shaping rings 26 with a thin flexible non-porous cover 27.

Figure 9:
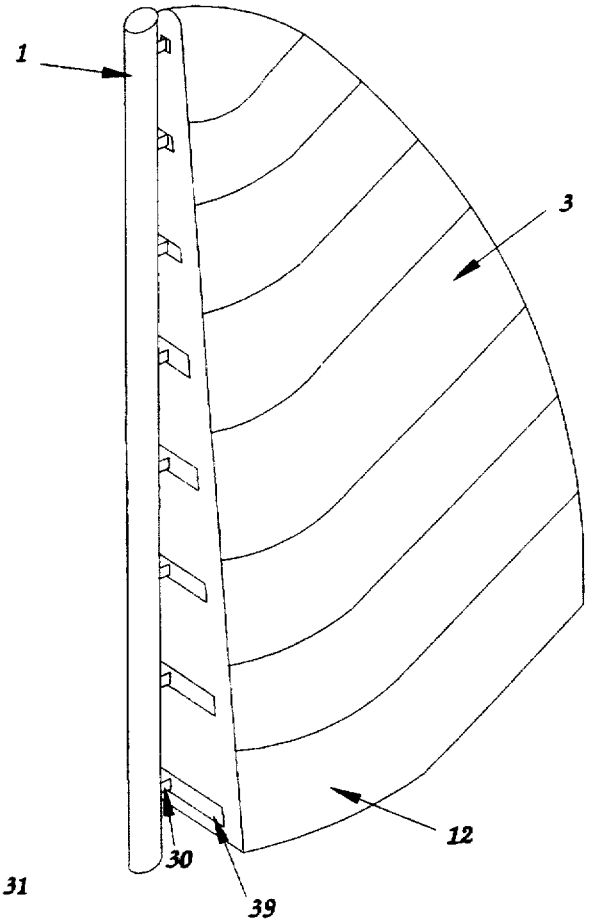
FIG. 9 is an isometric view of the main body portion of the main sail in a fully inflated state, attached to a conventional mast.

FIG. 9 is a view of the main body portion 3 of the main sail attached to a mast. This illustration shows the outer cover 12, mast 1, attachment points 30, and shifting slots 39. The main body portion 3 of the main sail will feature two inflatable cells (port inflatable cell and starboard inflatable cell) enclosed in an outer cover 12. The outer cover 12 will be attached (zipper or permanent) to the leech portion of the center panel. The outer cover will not be directly attached to the forward wall of the inflatable cells. The outer cover 12 will be manufactured using a sail cloth material (canvas, dacron, mylar, or other material that have similar or superior characteristics).

Figure 10:
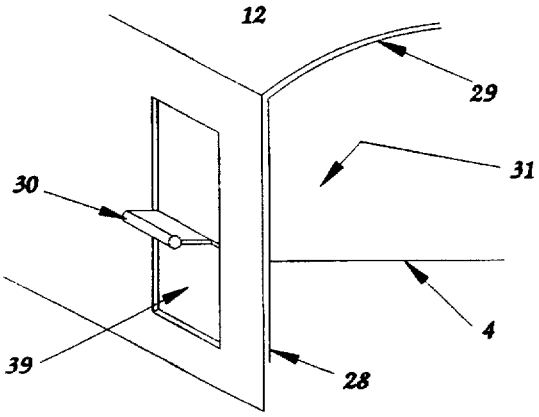
FIG. 10 is a close-up isometric view of a portion of the main body portion of the main sail.

FIG. 10 is a close-up isometric view of the luff portion of the main body portion of the main sail. The inflatable cells feature a common center panel 4, forward wall 28, outer wall 29, bottom wall 31, outer cover 12, and shifting slots 39. The figure also shows the attachment points 30 used to attach the sail to the mast.

FIG. 11 is an isometric view of the main body portion 3 of the main sail. The main body sail 3 will feature two inflatable cells (port inflatable cell 9 and starboard inflatable cell 10) enclosed in an outer cover (as seen in FIG. 9).

The inflatable cells will feature two inflating/deflating tubes (as illustrated in FIG. 12) that will exit the main body sail 3 via one of six connecting valves; bottom connecting valves 32 (one each side of the sail; port and starboard), first reef point connecting valves 33 (one each side of the sail; port and starboard), second reef point connecting valves 34 (one each side of the sail; port and starboard). The bottom connecting valves 32 will be located along bottom of the main body sail 3. The first reef point connecting valves 33 will be located along the luff (forward panel 28) of the main body sail 3, at the same level as the first reef point grommets 35. The first reef point will have two grommets 35; one incorporated into the luff portion and the other incorporated into the leech portion of the main body sail 3. The second reef point connecting valves 34 will be located along the luff of the main body sail 3, at the same level as the second reef point grommets 36. The second reef point will have two grommets 36; one incorporated into the luff portion and the other incorporated into the leech portion of the sail 3. This illustration also shows the position of the tack grommet 7 and clew grommet 8.

When the main body sail 3 is lowered to the first reef point, the sail is secured using a conventional reefing hook and first reefing line. The main body inflation hoses 37 (one each side of the sail; port and starboard—See FIG. 7) can be disconnected from the bottom connecting valves 32 and connected to the first reefing point connecting valves 33. When the main body sail 3 is lowered to the first reef position, the back-flow valves contained in the first reef point connecting valves 33 (port and starboard) can be turned to the closed position. This allows the inflation medium to inflate the inflatable cells (port inflatable cell 9 and starboard inflatable cell 10) located in the upper portion of the main body sail 3, above the first reef point, but prevents the inflation medium from inflating the inflatable cells (port inflatable cell 9 and starboard inflatable cell 10) located in the lower portion of the sail 3, below the first reef point. The same method is used to inflate the upper portion of the inflatable port inflatable cells (port inflatable cell 9 and starboard inflatable cell 10) above the second reef point, but prevents the inflation medium from inflating the inflatable cells (port inflatable cell 9 and starboard inflatable cell 10) located in the lower portion of the sail 3, below the second reef point.

When the sailing vessel is on port tach the starboard inflatable cell 10 should be fully or near fully inflated and the port inflatable cell 9 should be deflated or only partially inflated. When the sailing vessel tachs from the port tach to a starboard tach, the starboard inflatable cell 10 should be fully deflated and the port inflatable cell 9 should be fully or nearly fully inflated. The action of deflating one side and inflating the other allows the forward portion of the outer cover 12 to shift from the deflated side to the inflated side. The shifting slots 39 as seen in FIG. 9 and 10 allows the forward portion of the outer cover to shift from the windward side to the leeward side of the sail.

When the inflatable cell situated on the leeward side of the boat is fully or nearly fully inflated, the inflatable cell situated on the windward side of the boat can be partially re-inflated to obtain the optimum or desired shape of the main sail 3 and sail.

FIG. 12 is a cutaway isometric view of the port side inflatable cell (starboard inflatable cell will be a mirror image) that is used as part of the main body portion of the main sail. The inflatable cells (port inflatable cell and starboard inflatable cell) will be of various sizes and shapes depending on the size and dimensions of the main body sail 3. When fully inflated, the cells will form a semi-airfoil shape that will be the main portion and trailing edge of the sail. The inflatable cells (port inflatable cell and starboard inflatable cell) will be manufactured using a non-porous or semi non-porous material. The inflatable cells will feature non-porous or semi non-porous outer walls (refer to Nos. 28 and 29 of FIG. 10) with shaping panels 11 attached to the interior opposed sides of the inflatable cells (port inflatable cell and starboard inflatable cell). The shaping panels 11 will be attached (using glue, heat, or other existing or future bonding method) to the inner walls of the cells. These shaping panels 11 will define the shape of the inflatable cells (port inflatable cell and starboard inflatable cell) when inflated with an inflation medium. All shaping panels 11 will have pass-through holes 38 that will allow the inflation medium to pass from the various sections of the inflatable cells (port inflatable cell and starboard inflatable cell). For viewing purposes, the pass-through holes are not shown on all of the shaping panels.

Each of the two inflatable cells (port inflatable cell and starboard inflatable cell) will feature one inflating/deflating tube 40. The main inflating/deflating tubes 40 will be situated near the luff portion of the inflatable cells (port inflating/deflating tube shown, starboard inflating/deflating tube will be a mirror image). The inflating/deflating tubes will extend the entire length of the inflatable cell. See FIG. 6 for a more detailed view of the inflating/deflating tubes. The inflating/deflating tube 40 (port and starboard) will connect to a one of three main connecting valves 32, 33, or 34 (three port and three starboard—see FIG. 11).

The two inflatable cells (port inflatable cell and starboard inflatable cell) can be inflated or deflated both in unison or independently to adjust the shape of the main portion of the sail. The inflatable cells (port inflatable cell and starboard inflatable cell) will be inflated with an inflation medium that will be transferred into the inflatable cell (port inflatable cell and starboard inflatable cell) via a main inflatable/deflatable tube 40 incorporated into the inflatable cell.

The inflation medium will be transferred into the inflating/deflating tubes 40 via an inflation hose 37 that connects to the main connecting valves 32, 33, or 34 (see FIG. 7). One of the two inflatable hoses connects to the port main connecting value and the other to the starboard main connecting value. The inflation hoses 37 will attach to the main connecting valves 32, 33, & 34 using male/female locking couplings (see FIG. 7).

Figure 13:
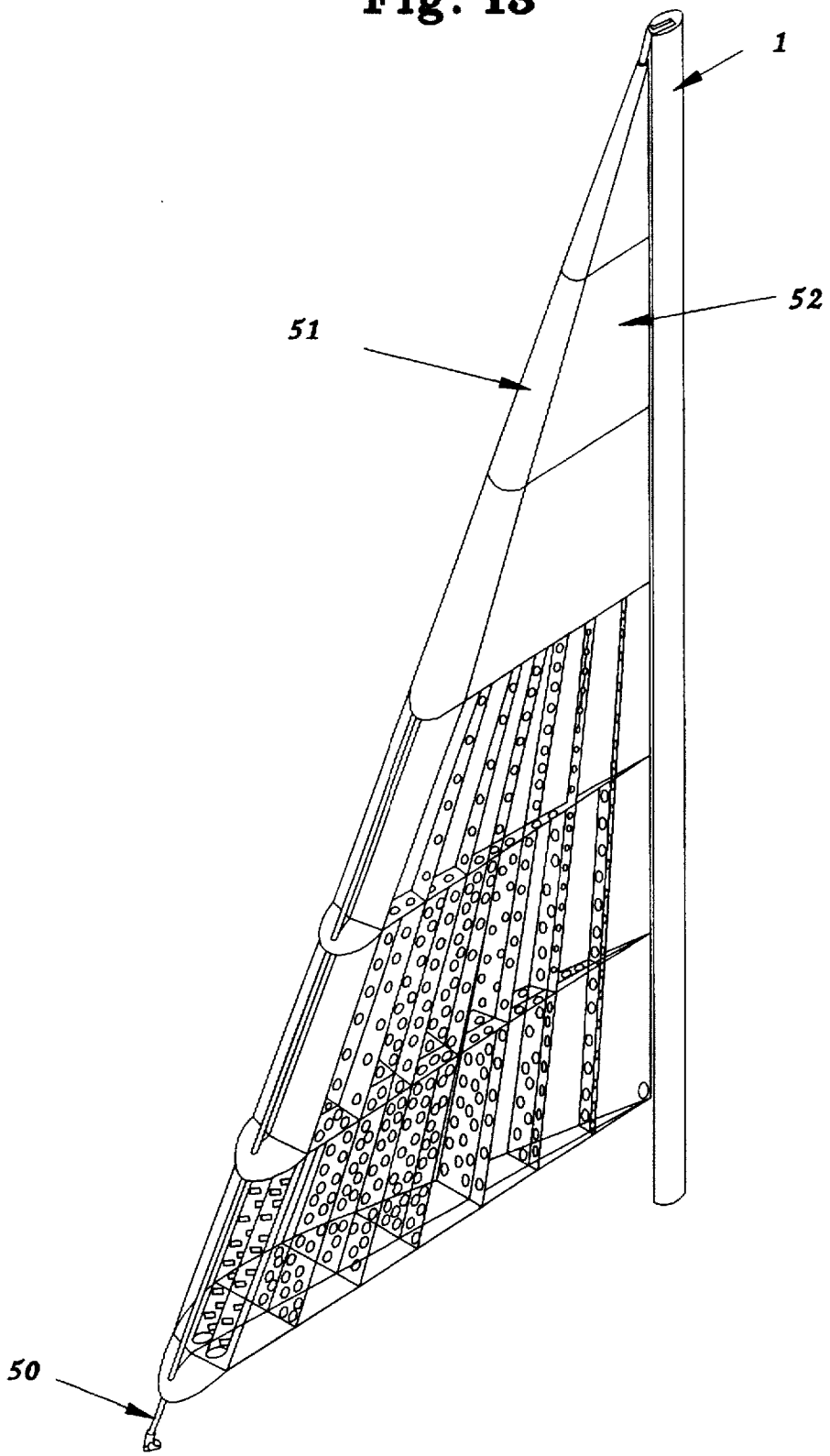
FIG. 13 is a cut away isometric view of the head sail portion of the invention attached to a headstay and mast.

FIG. 13 is an isometric (cut-away) view of the head sail portion of the invention attached to a conventional sailing rig of a typical sailing vessel, that includes a fixed mast 1 and a headstay 50. The head sail will feature a leading edge cone 51 and a main body sail 52 portion. The head sail is attached to the leading edge cone in a conventional manner that includes several attachment points (refer to No. 61 of FIG. 16 and 17) incorporated into the luff portion of the center panel of the main body portion 52 of the head sail that are inserted into a "C" shaped channel that is part of the leading edge cone 51.

Figure 14:
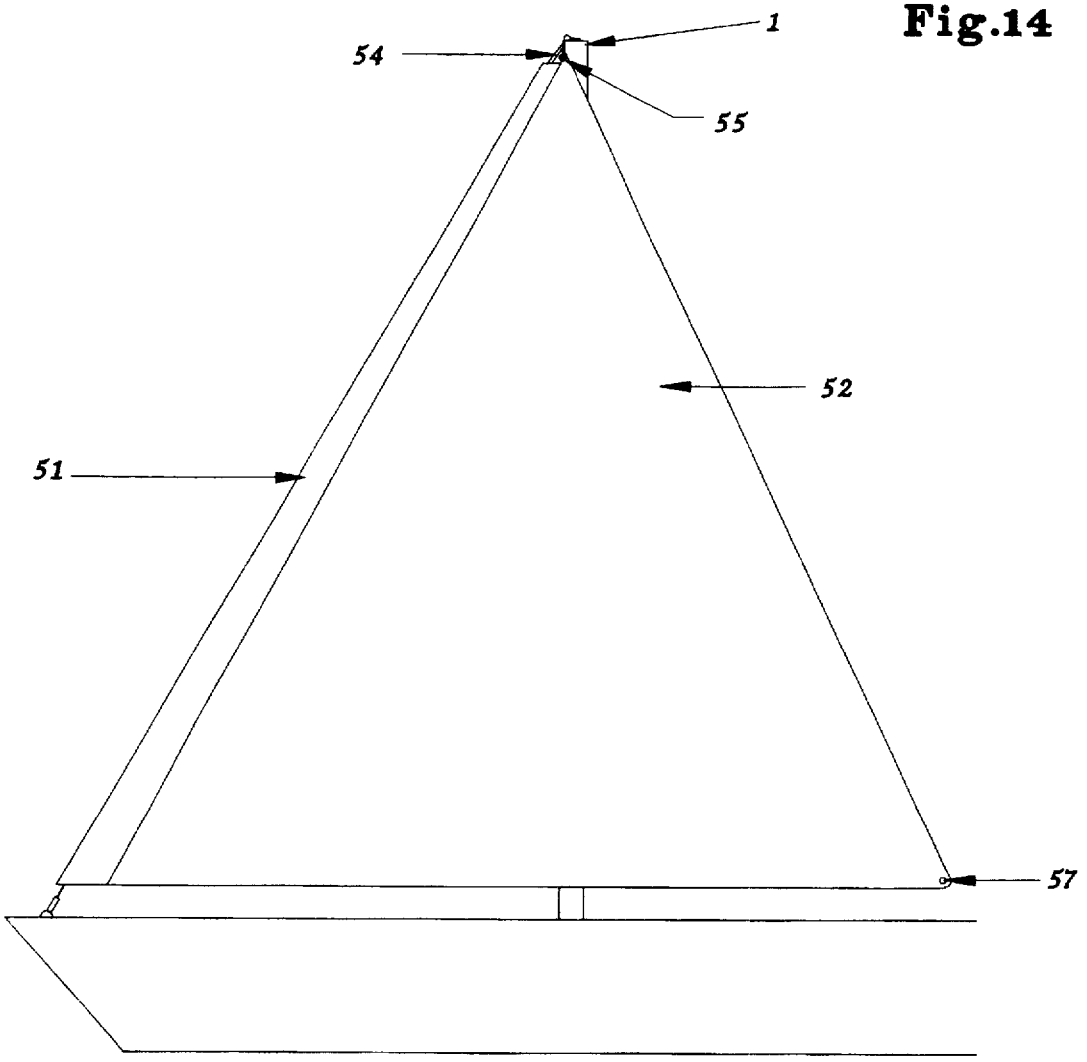
FIG. 14 is a side view of the head sail portion of the invention attached to a headstay and mast.

FIG. 14 is a side view of the head sail in a fully inflated state on (starboard tach). This view shows the main body sail 52 and the leading edge cone 51 attached to a conventional headstay 50.

The main body sail 52 is raised and lowered in a conventional manner using a head sail halyard 54 that is attached to a grommet 55 incorporated into the head portion of the main body sail 52. The main body sail 52 also includes a grommet 56 incorporated into the tack portion of the head sail (refer to FIG. 17) and a grommet 57 incorporated into the clew portion of the main body sail. The tack grommet 56 is used to attach the sail to the foredeck and the clew grommet 57 is used to attach head sail control sheets.

Figure 15:
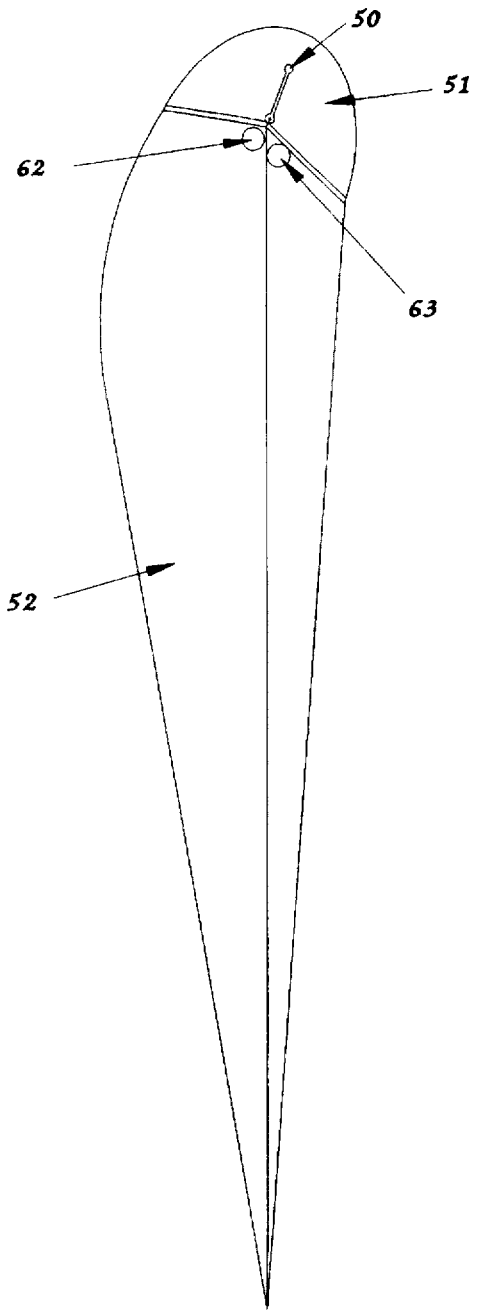
FIG. 15 is a cross section view of the headsail portion of the invention in a fully inflated state, on starboard tach.

FIG. 15 is a cross section view of the head sail in a fully inflated state on (starboard tach). This view shows the main body sail 52 and the leading edge cone 51 attached to a conventional headstay 50.

Figure 16:
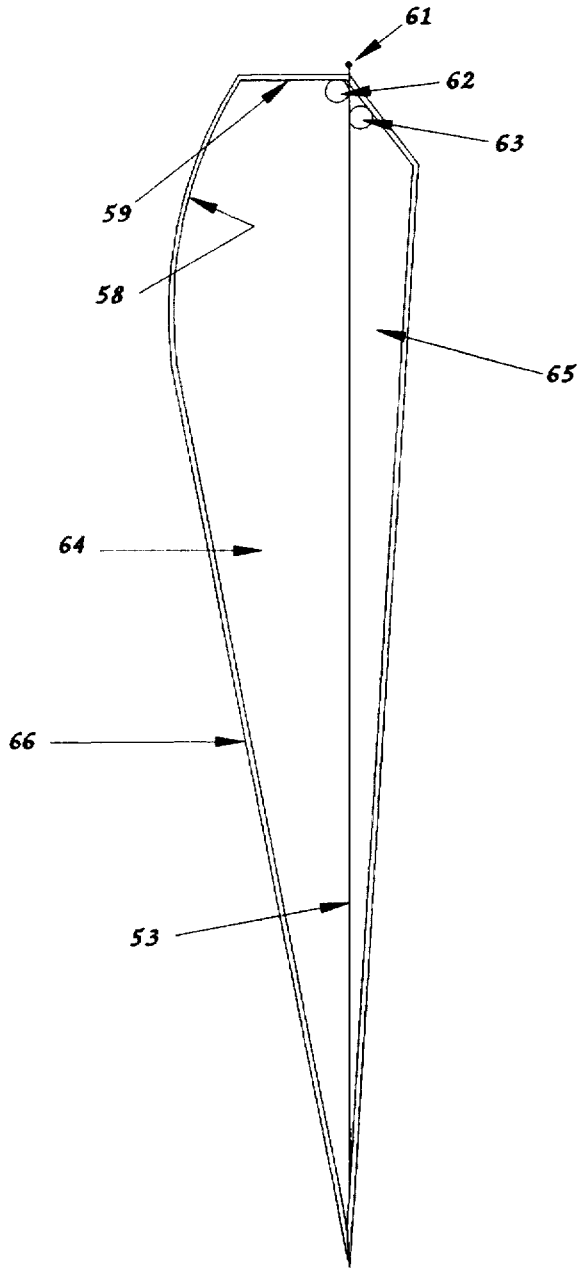
FIG. 16 is a cross section view of the main body portion of the headsail in a fully inflated state.

FIG. 16 is a cross section view of the main body portion of the head sail in a fully inflated state (starboard tach). The head sail will feature two inflatable cells (port inflatable cell 64 and starboard inflatable cell 65) enclosed in an outer cover 66. This view shows the outer panel 58, forward panel 59, center panel 53, and headstay attachments 61. This view also shows the inflating/deflating tubes (port inflating/deflating tube 62 and starboard inflating/deflating tube 63).

The outer cover 66 will be attached (zipper or permanent) to the leech portion of the center panel 53. The outer cover will not be directly attached to the forward wall of the inflatable cells. The outer cover 66 will be manufactured using a sail cloth material (canvas, dacron, mylar, or other material that have similar or superior characteristics).

Figure 17:
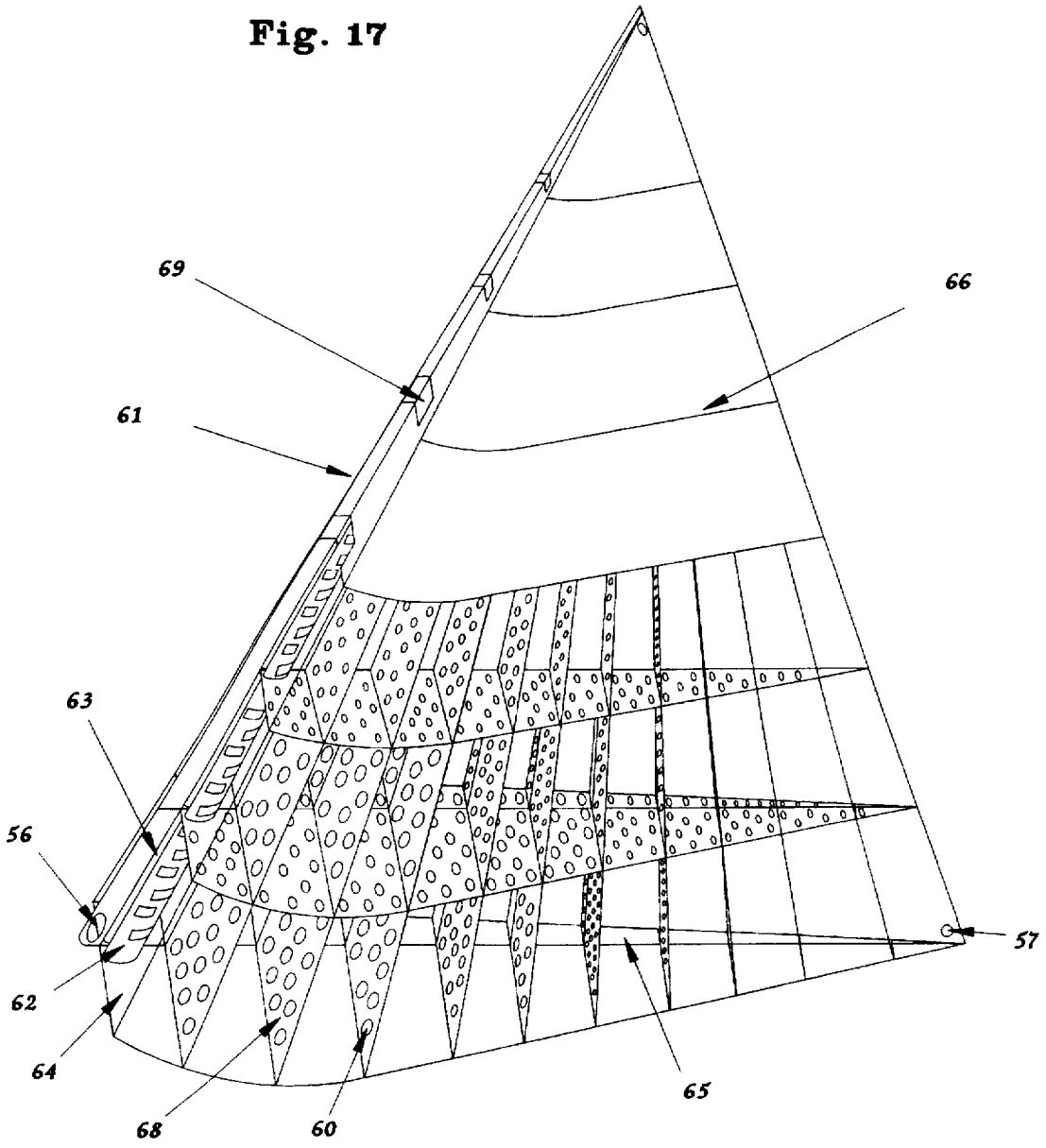
FIG. 17 is an isometric view of the main body portion of the headsail in a fully inflated state.

FIG. 17 is a cut away isometric view of the main body portion of the head sail. The upper portion of the figure shows the outer cover 66 and shifting slots 69. The lower portion of the figure shows the inflatable cell. The two sided inflatable cell (including one port inflatable cell 64 and one starboard inflatable cell 65) will be of various sizes and shapes depending on the size and dimensions of the head sail. When fully inflated, the cells will form a semi-airfoil shape that will be the main portion and trailing edge of the head sail. This figure also shows the position of the tack grommet 56 and clew grommet 57.

The inflatable cell (port inflatable cell 64 and starboard inflatable cell 65) will be manufactured using a non-porous or semi non-porous material. The inflatable cells will feature a non-porous or semi non-porous outer walls with shaping panels 68 attached to the interior opposed sides of the inflatable cells (port inflatable cell 64 and starboard inflatable cell 65). The shaping panels 68 will be attached (using glue, heat, or other existing or future bonding method) to the inner walls of the cells. These shaping panels 68 will define the shape of the inflatable cells (port inflatable cell 64 and starboard inflatable cell 65) when inflated with an inflation medium. These shaping panels 68 will have pass-through holes 60 that will allow the inflation medium to pass from the various sections of the inflatable cells (port inflatable cell 64 and starboard inflatable cell 65).

Each side of the inflatable cell (port inflatable cell 64 and starboard inflatable cell 65) will feature one inflating/deflating tube (port inflating/deflating tube 62 and starboard inflating/deflating tube 63). The main inflating/deflating tubes (port inflating/deflating tube 62 and starboard inflating/deflating tube 63) will be situated near the luff portion of the inflatable cells. The inflating/deflating tubes will extend the entire length of the inflatable cell. See FIG. 8 for a more detailed view of the inflating/deflating tubes. The port inflating/deflating tube 62 and starboard inflating/deflating tube 63 will connect to the main connecting valves (Refer to FIG. 20).

The two inflatable cells (port inflatable cell 64 and starboard inflatable cell 65) can be inflated or deflated both in unison or independently to adjust the shape of the main body portion of the head sail. The inflatable cells (port inflatable cell 64 and starboard inflatable cell 65) will be inflated with an inflation medium that will be transferred into the inflatable cell (port inflatable cell 64 and starboard inflatable cell 65) via a main inflating/deflating tubes (port inflating/deflating tube 62 and starboard inflating/deflating tube 63) incorporated into the inflatable cell. The inflation medium will be transferred into the inflating/deflating tubes (port inflating/deflating tube 62 and starboard inflating/deflating tube 63) via the main connecting valves 67 that connects to an inflation hose 70 (refer to FIG. 20).

FIG. 18 is an isometric view of the leading edge cone 51 headstay 50 and a swivel plate located near the masthead. The leading edge cone 51 is fitted over the headstay 50 and is attached to the headstay with two swivel plates; one located near the headstay attachment at the deck and the other located near the mast head. The leading edge cone is an semi-arrowhead shaped piece as shown in the cross section view FIG. 19. The width of the leading edge cone ranges from relatively wide near the bottom (near the fore deck of the sailing vessel) to relatively narrow near the masthead (top of the mast). The exact width of the leading edge cone is dependent on the size of the sailing vessel, rig, and maximum camber of the head sail. The length of the leading edge cone is dependent on the size of the sailing vessel and rig, but is generally the same (slightly shorter) length as the headstay 50.

FIG. 19 is a cross section view of the leading edge cone. The leading edge cone is manufactured using either: (a) a Styrofoam (or other material that has similar characteristics) core 72 with an outer cover 73 (fiberglass and gelcoat or other material that has similar characteristics such as plastic) or (b) a hollow core 72 with a fiberglass and gelcoat cover 73 (or other material that has similar characteristics such as plastic). The hollow core version of the leading edge cone will feature two inflatable cells contained within the outer cover 73. The inflatable cells (port side inflating cell 79 and starboard side inflatable cell 80) can be inflated or deflated The inflatable cells (port side inflating cell 79 and starboard side inflatable cell 80) will be inflated with an inflation medium that will be transferred into the inflatable cell (port side inflating cell 79 and starboard side inflatable cell 80) via a main inflating/deflating tubes (port inflating/deflating tube 81 and starboard inflating/deflating tube 82) incorporated into the inflatable cell. The inflation medium will be transferred into the inflating/deflating tubes (port inflating/deflating tube 81 and starboard inflating/deflating tube 82) via the main connecting valves 75 that connects to an inflation hose 76 (refer to FIG. 20).

The outer cover of the inflatable version will also feature either one or several hinge points 83 to allow the outer walls of the cover 73 to be drawn toward the center. The inner portion of the leading edge cone will feature a (metallic) headstay tube 74 that runs the entire length of the leading edge cone. This tube 74 attaches to the two swivel plates (the lower swivel plate is identified as 78 on FIG. 20). The swivel plate attachments allow the leading edge cone to swivel around the headstay (refer to FIG. 20). The head sail is attached to the leading edge cone in a conventional manner that includes several attachment points incorporated into the luff portion of the center panel of the main body sail (refer to FIG. 17), that are inserted into a "C" shaped channel 77 that is part of the leading edge cone.

FIG. 20 is an isometric view of the bottom walls of the head sail (main body portion 52 and leading edge cone 51). The inflation medium will be transferred into the inflating/deflating tubes 62 and 63 of the main body portion of the head sail via the main connecting valves 67, which are connected to the inflation hoses 70. One of the four inflatable hoses connects to each of the inflatable cells; leading edge port inflatable cell, leading edge starboard inflatable cell, port main body inflatable cell, and starboard main body inflatable cell. The inflation hoses 70 will attach to the main connecting valves 67 using male/female locking couplings 71. The inflation hoses 76 will attach to the leading edge connecting valves 75 using male/female locking couplings 71.

When the sailing vessel is on port tach the starboard inflatable cells should be fully or near fully inflated and the port inflatable cells should be deflated or only partially inflated. When the sailing vessel tachs from the port tach to a starboard tach, the starboard inflatable cells should be fully deflated and the port inflatable cells should be fully or nearly fully inflated. The action of deflating one side and inflating the other allows the forward portion of the outer cover to shift from the deflated side to the inflated side. The shifting slots 69 (refer to FIG. 17) allows the forward portion of the outer cover to shift from the windward side to the leeward side of the sail.

When the inflatable cell situated on the leeward side of the boat is fully or nearly fully inflated, the inflatable cell situated on the windward side of the boat can be partially re-inflated to obtain the optimum or desired shape of the head sail.

What is claimed is:

1. A two-piece adjustable camber wing-shaped inflatable sail for use as a main and or misin sail by contemporary sailing vessels with conventional sail rig having a mast, boom, headstay, backstay, and sidestays; that features a leading edge portion and physically separate main body portion, each having two inflatable cells; one port and one starboard, each enclosed in an outer cover to provide a means of producing forward propulsion that consists of;

a main two-chamber inflatable cell that forms the main body and trailing edge portions of said sail that is designed in a conventional semi-triangular sail shape with a series of attachments incorporated in to a common center panel of said cell to be attached to a conventional sail rig that includes a fixed mast and boom, compatible with the various sail rigs; featuring independent port and starboard inflatable cells on either side of said center panel being substantially air-tight and of various size and shape depending on the size and dimensions of said sail enclosed in an outer cover attached along the leach portion of said cell;

and a physically separate two-chamber inflatable cell pocket that forms the leading edge portion of said sail that will attach to the forward and side portions of the mast, extending from the lower portion of the mast, just above the boom to within several inches above or below the masthead; and will feature two mirror image chambers that form a semi-wedge shape around the mast with independent port and starboard inflatable semi-wedge shaped cells that are the same general shape as the inside portion of the two cell pocket chambers and are substantially air-tight and will fit snugly and expand into the inside portion of the two cell pocket chambers.

2. A two-piece adjustable camber wing-shaped inflatable sail for use as a foresail or headsail by contemporary sailing vessels with conventional sailing rigs having a mast, boom, headstay, backstay, and sidestays; that features a leading edge portion and physically separate main body portion, each having two inflatable cells; one port and one starboard, each enclosed in an outer cover to provide a means of producing forward propulsion that consists of:

a main two-chamber inflatable cell that forms the main body and trailing edge portions of said sail that is designed in a conventional semi-triangular sail shape with a series of attachments incorporated in to a common center panel of said cell to allow said cell to be attached to a conventional sail rig that includes a fixed mast and forestay, compatible with the various sail rigs; featuring independent port and starboard inflatable cells on either side of said center panel being substantially air-tight, enclosed in an outer cover attached along the leach portion of said cell;

and a physically separate semi-arrowhead shaped leading edge cone that will form the leading edge portion of said sail, ranging in width from relatively wide near the bottom, near the fore deck of the sailing vessel to relatively narrow near the mast; attaching to the headstay and extending from the lower portion of the headstay, just above the deck to within several inches above or below the point where the headstay attaches to the mast; and will feature a two-chamber inflatable leading edge cone with two mirror image chambers with independent port and starboard inflatable semi-wedge shaped cells that are substantially air-tight and will fit snugly into and be of the same general shape as the inside portion of the two chambers and can be inflated and deflated independently to adjust the shape of the two-chamber inflatable leading edge cone.

3. A two-piece adjustable camber wing-shaped inflatable sail for use as a foresail or headsail by contemporary sailing vessels with conventional sailing rigs having a mast, boom, headstay, backstay, and sidestays; that features a leading edge portion and physically separate main body portion, having two inflatable cells; one port and one starboard, enclosed in an outer cover to provide a means of producing forward propulsion that consists of:

a main two-chamber inflatable cell that forms the main body and trailing edge portions of said sail that is designed in a conventional semi-triangular sail shape with a series of attachments incorporated in to a common center panel of said cell to allow said cell to be attached to a conventional sail rig that includes a fixed mast and forestay, compatible with the various sail rigs; featuring independent port and starboard inflatable cells on either side of said center panel being substantially air-tight, enclosed in an outer cover attached along the leach portion of said cell;

and a physically separate semi-arrowhead shaped leading edge cone that will form the leading edge portion of said sail, ranging in width from relatively wide near the bottom, near the fore deck of the sailing vessel to relatively narrow near the mast; attaching to the headstay and extending from the lower portion of the headstay, just above the deck to within several inches above or below the point where the headstay attaches to the mast; and will feature a solid, light-weight inner core enclosed with a hard exterior cover.

4. An adjustable camber wing-shaped inflatable sail as defined in claim 1 wherein the two inflatable cells of the main body portion of said sail will be of various size and shape depending on the size and dimensions of said sail with the port side inflatable cell being formed by the common center panel, port outer wall, port forward wall, and port bottom wall; and the starboard side inflatable cell is formed by the common center panel, starboard outer wall, starboard forward wall, and starboard bottom wall.

5. An adjustable camber wing-shaped inflatable sail as defined in claim 1 wherein the port and starboard sides of the inflatable cells that are the main body portion of said sail will each feature a plurality of horizontally positioned shaping panels attached to the interior opposed sides of the cells dividing said cells into segmented chambers that will define the shape of each individual cell when inflated with an inflation medium with pass-through holes that will allow the inflation medium to pass from one section of the port side inflatable cell to the other sections of the port side inflatable cell and from one section of the starboard side inflatable cell to the other sections of the starboard side inflatable cell.

6. An adjustable camber wing-shaped inflatable sail as defined in claim 1 wherein the inflation medium will be transferred into the two cells of the main body portion of said sail via two main inflating/deflating tubes; one port and one starboard tube, each will run the entire length of the luff portion of the inflatable cells with opening ports to each section of the inflatable cells and will exit the cells via one of six valves; three on the port side and three on the starboard side; one set located near the bottom of the cell, a second set located slightly above a first reef point, and a third set located slightly above a second reef point.

7. An adjustable camber wing-shaped inflatable sail as defined in claim 1 wherein the outer cover of the main body portion of said sail will be attached along the leach portion of the cell and will be manufactured using a non-elastic material that will resist stretching when pressure is applied from the inflation of the inflatable cells; and will also feature horizontal shifting slots incorporated into the forward portion of the cover, near the mast.

8. An adjustable camber wing-shaped inflatable sail as defined in claim 1 wherein the outer cover of the main body portion of said sail will be attached along the leach portion of said cell and will be manufactured using an elastic material that will stretch when pressure is applied from the inflation of the inflatable cells of said cell and will return to its original shape when pressure applied from inflation of the inflatable cells is removed and will also feature horizontal shifting slots incorporated into the forward portion of the cover, near the mast.

9. An adjustable camber wing-shaped inflatable sail as defined in claim 1 wherein the main body portion of said sail will also feature six grommets including one located in the clew portion and the other located in the tack portion of the sail, a second set identified as the first reef point grommets located near the luff of the sail and the other near the leach of the sail, and a third set identified as the second reef point grommets located near the luff of the sail and the other near the leach of the sail.

10. An adjustable camber wing-shaped inflatable sail as defined in claim 1 wherein the two-chamber inflatable cell pocket that forms the leading edge portion of said sail will be of various size and shape depending on the size and dimensions of said sail and will feature a port side cell pocket and a starboard side cell pocket formed by a common outer wall, two inner walls, one port and one starboard, two rear walls, one port and one starboard, and two bottom walls, one port and one starboard; wherein the two inner walls permanently attached to the common outer wall and rear walls with a zipper to attach the outer wall to the two rear walls.

11. An adjustable camber wing-shaped inflatable sail as defined in claim 1 wherein the leading edge portion of said sail will be attached to the mast with a two-piece Velcro® system, or attachment system or method that has similar attachment characteristics with the hook side of the Velcro® system attached to the mast with a glue or other semi-permanent attachment system and the loop side of the Velcro® system incorporated into the inner wall of the leading edge portion of said sail.

12. An adjustable camber wing-shaped inflatable sail as defined in claim 1 wherein the two-chamber cell pocket has inner walls, rear walls, and bottom walls that form the leading edge portion of said sail, and wherein the inner walls and bottom walls will be manufactured using a semi-non-elastic material that will resist stretching when pressure is applied from the inflation of the inflatable cells; the rear walls will be manufactured using an elastic, defined as highly flexible, tending to revert to its original shape after distortion, recovering its original form or condition readily material that will stretch when pressure is applied from the inflation of the inflatable cells and will return to its original shape when the inflatable cells are deflated; and the outer cover will be manufactured using a non-elastic material.

13. An adjustable camber wing-shaped inflatable sail as defined in claim 1 wherein the port and starboard inflatable cells that are part of the leading edge portion of said sail will each feature a plurality of horizontally positioned shaping panels attached to the interior opposed sides of the cells dividing said cells into segmented chambers that will define the shape of each individual cell when inflated with an inflation medium with pass-through holes that will allow the inflation medium to pass from one section of the port side inflatable cell to the other sections of the port side inflatable cell and from one section of the starboard side inflatable cell to the other sections of the starboard side inflatable cell.

14. An adjustable camber wing-shaped inflatable sail as defined in claim 1 wherein the inflation medium will be transferred into the two inflatable cells of the leading edge portion of said sail via two main inflating/deflating tubes; one port and one starboard tube, each will run the entire length of the luff portion of the inflatable cells with opening ports to each section of the inflatable cells and will exit the cells via two valves; one port and one starboard side.

15. An adjustable camber wing-shaped inflatable sail as defined in claim 2 wherein the two inflatable cells of the main body portion of said sail will be of various size and shape depending on the size and dimensions of said sail with the port side inflatable cell being formed by the common center panel, port outer wall, port forward wall, and port bottom wall; and the starboard side inflatable cell is formed by the common center panel, starboard outer wall, starboard forward wall, and starboard bottom wall.

16. An adjustable camber wing-shaped inflatable sail as defined in claim 2 wherein the port and starboard sides of the inflatable cells that are the main body portion of said sail will each feature a plurality of horizontally positioned shaping panels attached to the interior opposed sides of the cells dividing said cells into segmented chambers that will define the shape of each individual cell when inflated with an inflation medium with pass-through holes that will allow the inflation medium to pass from one section of the port side inflatable cell to the other sections of the port side inflatable cell and from one section of the starboard side inflatable cell to the other sections of the starboard side inflatable cell.

17. An adjustable camber wing-shaped inflatable sail as defined in claim 2 wherein the inflation medium will be transferred into the two cells of the main body portion of said sail via two main inflating/deflating tubes; one port and one starboard tube, each will run the entire length of the luff portion of the inflatable cells with opening ports to each section of the inflatable cells and will exit the cells via one of six valves; three on the port side and three on the starboard side; one set located near the bottom of the cell, a second set located slightly above a first reef point, and a third set located slightly above a second reef point.

18. An adjustable camber wing-shaped inflatable sail as defined in claim 2 wherein the outer cover of the main body portion of said sail will be attached along the leach portion of the cell and will be manufactured using a non-elastic material that will resist stretching when pressure is applied from the inflation of the inflatable cells; and will also feature horizontal shifting slots incorporated into the forward portion of the cover, near the mast.

19. An adjustable camber wing-shaped inflatable sail as defined in claim 2 wherein the outer cover of the main body portion of said sail will be attached along the leach portion of said cell and will be manufactured using an elastic material that will stretch when pressure is applied from the inflation of the inflatable cells of said cell and will return to its original shape when pressure applied from inflation of the inflatable cells is removed and will also feature horizontal shifting slots incorporated into the forward portion of the cover, near the mast.

20. An adjustable camber wing-shaped inflatable sail as defined in claim 2 wherein the two-chamber inflatable leading edge cone is formed by a panelized outer cover, common inner wall, two rear walls, one port and one starboard, and two bottom walls, one port and one starboard; wherein the rear walls and bottom walls will be manufactured using a non-elastic or semi-non-elastic material that will resist stretching when pressure is applied from the inflation of the inflatable cells, an outer cover featuring longitudinal panelized sections manufactured using a non-elastic, semi-hard material and a solid inner wall that will be manufactured using a non-elastic, semi-hard material.

21. An adjustable camber wing-shaped inflatable sail as defined in claim 2 wherein the two-chamber inflatable leading edge cone of said sail will be of various size and shape depending on the size and dimensions of said sail and will feature a port side cell pocket and a starboard side cell pocket formed by a common outer wall, two inner walls, one port and one starboard, two rear walls, one port and one starboard, and two bottom walls, one port and one starboard; wherein the two inner walls permanently attached to the common outer wall and rear walls with a zipper to attach the outer wall to the two rear walls.

22. An adjustable camber wing-shaped inflatable sail as defined in claim 2 wherein the two-chamber inflatable leading edge cone has inner walls and bottom walls manufactured using a semi-non-elastic material that will resist stretching when pressure is applied from the inflation of the inflatable cells, and rear walls manufactured using an elastic, defined as highly flexible, tending to revert to its original shape after distortion, recovering its original form or condition readily material that will stretch when pressure is applied from the inflation of the inflatable cells and will return to its original shape when the inflatable cells are deflated; and the outer cover will be manufactured using a non-elastic material.

23. An adjustable camber wing-shaped inflatable sail as defined in claim 2 wherein the port and starboard inflatable cells that are part of the leading edge cone of said sail will each feature a plurality of horizontally positioned shaping panels attached to the interior opposed sides of the cells dividing said cells into segmented chambers that will define the shape of each individual cell when inflated with an inflation medium with pass-through holes that will allow the inflation medium to pass from one section of the port side inflatable cell to the other sections of the port side inflatable cell and from one section of the starboard side inflatable cell to the other sections of the starboard side inflatable cell.

24. An adjustable camber wing-shaped inflatable sail as defined in claim 2 wherein the inflation medium will be transferred into the two inflatable cells of the leading edge cone of said sail via two main inflating/deflating tubes; one port and one starboard tube, each will run the entire length of the luff portion of the inflatable cells with opening ports to each section of the inflatable cells and will exit the cells via two valves; one port and one starboard side.

25. An adjustable camber wing-shaped inflatable sail as defined in claim 2 wherein the leading edge cone will attach to the headstay with two swivel plates; one located near the headstay attachment at the deck and the other located near the mast head.

26. An adjustable camber wing-shaped inflatable sail as defined in claim 2 wherein the leading edge cone will feature a metallic attachment channel situated along the center line, near the rear wall that extends the entire length of the leading edge cone; that is used to attach the main two-chamber inflatable cell to the leading edge cone.

27. An adjustable camber wing-shaped inflatable sail as defined in claim 3 wherein the two inflatable cells of the main body portion of said sail will be of various size and shape depending on the size and dimensions of said sail with the port side inflatable cell being formed by the common center panel, port outer wall, port forward wall, and port bottom wall; and the starboard side inflatable cell is formed by the common center panel, starboard outer wall, starboard forward wall, and starboard bottom wall.

28. An adjustable camber wing-shaped inflatable sail as defined in claim 3 wherein the port and starboard sides of the inflatable cell that is the main body portion of said sail will each feature a plurality of horizontally positioned shaping panels attached to the interior opposed sides of the cells dividing said cells into segmented chambers that will define the shape of each individual cell when inflated with an inflation medium with pass-through holes that will allow the inflation medium to pass from one section of the port side inflatable cell to the other sections of the port side inflatable cell and from one section of the starboard side inflatable cell to the other sections of the starboard side inflatable cell.

29. An adjustable camber wing-shaped inflatable sail as defined in claim 3 wherein the inflation medium will be transferred into the two cells of the main body portion of said sail via two main inflating/deflating tubes; one port and one starboard tube, each will run the entire length of the luff portion of the inflatable cells with opening ports to each section of the inflatable cells and will exit the cells via one of six valves; three on the port side and three on the starboard side; one set located near the bottom of the cell, a second set located slightly above a first reef point, and a third set located slightly above a second reef point.

30. An adjustable camber wing-shaped inflatable sail as defined in claim 3 wherein the outer cover of the main body portion of said sail will be attached along the leach portion of the cell and will be manufactured using a non-elastic material that will resist stretching when pressure is applied from the inflation of the inflatable cells; and will also feature horizontal shifting slots incorporated into the forward portion of the cover, near the mast.

31. An adjustable camber wing-shaped inflatable sail as defined in claim 3 wherein the outer cover of the main body portion of said sail will be attached along the leach portion of said cell and will be manufactured using an elastic material that will stretch when pressure is applied from the inflation of the inflatable cells of said cell and will return to its original shape when pressure applied from inflation of the inflatable cells is removed and will also feature horizontal shifting slots incorporated into the forward portion of the cover, near the mast.

32. An adjustable camber wing-shaped inflatable sail as defined in claim 3 wherein the leading edge cone is formed by an outer cover and bottom wall all manufactured using a non-elastic, semi-hard material with a solid or light weight core and a metallic attachment channel situated along the center line, near the rear wall that extends the entire length of the leading edge cone; that is used to attach the main two-chamber inflatable cell to the leading edge cone.

33. An adjustable camber wing-shaped inflatable sail as defined in claim 3 wherein the leading edge cone will attach to the headstay with two swivel plates; one located near the headstay attachment at the deck and the other located near the mast head.

* * * * *